US012611568B2

(12) United States Patent
Hu

(10) Patent No.: US 12,611,568 B2
(45) Date of Patent: Apr. 28, 2026

(54) TREADMILL

(71) Applicant: Yongkang Tiantian Aipao Intelligent Technology Co., Ltd., Jinhua (CN)

(72) Inventor: Jiachen Hu, Jinhua (CN)

(73) Assignee: Yongkang Tiantian Aipao Intelligent Technology Co., Ltd., Jinhua (CN)

( * ) Notice: Subject to any disclaimer, the term of this patent is extended or adjusted under 35 U.S.C. 154(b) by 54 days.

(21) Appl. No.: 18/649,972

(22) Filed: Apr. 29, 2024

(65) Prior Publication Data

US 2025/0229124 A1 Jul. 17, 2025

(30) Foreign Application Priority Data

Jan. 12, 2024 (CN) ..... 202410054261.5
Mar. 15, 2024 (CN) ..... 202410303362.1

(51) Int. Cl.
*A63B 22/02* (2006.01)
*A63B 22/00* (2006.01)

(52) U.S. Cl.
CPC ..... *A63B 22/0235* (2013.01); *A63B 22/0046* (2013.01)

(58) Field of Classification Search
CPC ..... A63B 22/0235; A63B 22/0046; A63B 22/0023
See application file for complete search history.

(56) References Cited

U.S. PATENT DOCUMENTS 4,344,616 A * 8/1982 Ogden ..... A63B 22/0023 482/54
4,913,396 A * 4/1990 Dalebout ..... A63B 22/0023 248/649
5,192,255 A * 3/1993 Dalebout ..... F16M 11/38 248/371
7,569,000 B2 * 8/2009 Wang ..... A63B 22/0023 482/54
7,789,807 B1 * 9/2010 Wang ..... A63B 22/0235 482/52
8,657,724 B2 * 2/2014 Yang ..... A63B 22/02 482/54
10,471,299 B2 * 11/2019 Powell ..... H02K 9/06
2006/0040798 A1 * 2/2006 Weier ..... A63B 22/02 482/54
2006/0287162 A1 * 12/2006 Lo ..... A63B 22/02 482/54
2007/0049464 A1 * 3/2007 Chou ..... A63B 22/0023 482/54
2008/0188358 A1 * 8/2008 Kuo ..... A63B 22/0235 482/54

(Continued)

*Primary Examiner* — Andrew S Lo

(57) ABSTRACT

Disclosed is a treadmill, including a treadmill main body frame, a running belt being arranged on the treadmill main body frame; and a treadmill head frame, the treadmill head frame being rotatably connected to a front end of the treadmill main body frame to lift or lower the treadmill main body frame. The treadmill head frame is equipped with a treadmill head housing, and the treadmill head frame has at least one position to cause a side of the treadmill head housing opposite to the running belt to be lower than an end of the running belt close to the treadmill head housing. After a front part of the treadmill is downturned integrally, a "panoramic treadmill platform" effect is formed visually, making the integral structure more beautiful.

10 Claims, 9 Drawing Sheets

(56) References Cited

U.S. PATENT DOCUMENTS

| | | | | |
|---|---|---|---|---|
| 2008/0300115 | A1* | 12/2008 | Erlandson | A63B 22/0207 482/54 |
| 2013/0123073 | A1* | 5/2013 | Olson | A63B 22/02 482/54 |
| 2014/0302967 | A1* | 10/2014 | Ashby | A63B 24/0087 482/4 |
| 2016/0166870 | A1* | 6/2016 | Lagree | A63B 24/0087 482/142 |
| 2016/0213976 | A1* | 7/2016 | So | A63B 71/0622 |
| 2016/0346596 | A1* | 12/2016 | Manzke | A63B 21/00069 |
| 2017/0189745 | A1* | 7/2017 | Hamilton | A63B 22/02 |
| 2017/0333743 | A1* | 11/2017 | Kuo | A63B 21/225 |
| 2018/0369634 | A1* | 12/2018 | Kueker | A63B 22/0023 |
| 2019/0321680 | A1* | 10/2019 | Manzke | A63B 71/0054 |
| 2023/0372772 | A1* | 11/2023 | Liao | A63B 21/0058 |

* cited by examiner

TREADMILL

CROSS-REFERENCE RELATED REFERENCE

This application claims priorities of the Chinese Patent Application No. 202410054261.5, filed on Jan. 12, 2024, and the Chinese patent application with the application No. 202410303362.1, filed on Mar. 15, 2024, the entire contents of which are incorporated herein by reference.

TECHNICAL FIELD

The present disclosure relates to the technical field of fitness equipment, and more particularly to a treadmill.

BACKGROUND

Running has become a sport suitable for all people, but when the outdoor weather is unfavorable, the people do not want to interrupt the fitness regime, a treadmill has become a more favorite way of running fitness. The treadmill is essential fitness equipment in many gymnasiums, and is also an essential good thing for many families to run and exercise.

The existing treadmills generally have a planar exercise mode and a climbing exercise mode. With regard to the climbing exercise mode, a lifting structure is generally adopted to lift a front end of the treadmill. The lifting structure, for example, in the prior disclosed patent documents CN218248322U and CN219941696U, includes turnable support legs. When the support legs are received or folded, the planar exercise mode is running; and when the support legs are unfolded, the front end of the treadmill is lifted and a treadmill platform is inclined, the climbing exercise mode is running.

Taking pictures in the prior disclosed patent document CN307898688S as an example, the front end of the treadmill generally has an outer housing body for accommodating various components including driving structures and elements. The outer housing body is generally higher than the treadmill platform.

In the climbing mode, a running intensity of the user is higher. Accordingly, a user's position on the treadmill platform is very easy to be more forward. However, due to the existence of the outer housing body with a higher height at the front end of the treadmill, in this mode, the user may easily kick the outer housing body, which is not only easy to damage the outer housing body, but also easy to affect a running rhythm of the user. Even in severe cases, it may make the user stumble when legs are retracted, having potential safety hazards. The adoption of the lifting structure with turnable support legs cannot solve the above technical problems, and therefore improvements are made.

SUMMARY

The present disclosure provides a treadmill to overcome the deficiencies in the prior art.

In order to solve the above technical problems, the present disclosure provides the following technical solutions.

A treadmill includes:

a treadmill main body frame, a driving roller being rotatably arranged at a front end of the treadmill main body frame, a driven roller being rotatably arranged at a rear end, and a running belt being sleeved on the driving roller and the driven roller; and a treadmill head frame, the treadmill head frame being rotatably connected to the front end of the treadmill main body frame to lift or lower the treadmill main body frame, the treadmill head frame being equipped with a treadmill head housing, and the treadmill head frame having at least one position to cause a side of the treadmill head housing opposite to the running belt to be lower than an end of the running belt close to the treadmill head housing.

In the above technical solution, preferably, first driving unit in transmission connection to the driving roller is fixedly mounted on the treadmill head frame.

In the above technical solution, preferably, a rotational connection point of the driving roller is concentric with that of the treadmill head frame.

In the above technical solution, preferably, the spacing between a rotational centerline of the driving roller and that of the treadmill head frame ranges from 0 mm to 25 mm.

In the above technical solution, preferably, the first driving unit is an electric motor, and the first driving unit is connected to the driving roller via a belt or chain in a transmission manner.

In the above technical solution, preferably, the first driving unit in transmission connection to the driving roller is fixedly mounted on the treadmill main body frame, the first driving unit being an electric motor, and the first driving unit being connected to the driving roller via a belt or chain in a transmission manner.

In the above technical solution, preferably, the front end of the treadmill main body frame includes threaded holes, bolts are threadedly connected to the threaded holes, shaft sleeves are arranged on the bolts, and the treadmill head frame is rotatably connected to the shaft sleeves.

In the above technical solution, preferably, first holes are disposed on the treadmill head frame, and first positioning pins are arranged on the first holes;

a plurality of second holes cooperating with the first positioning pins are disposed on the treadmill main body frame, and arrangement positions of the second holes correspond to movement paths of the first holes; and the treadmill head frame is positioned when inner ends of the first positioning pins are inserted into the corresponding second holes.

In the above technical solution, preferably, a plurality of support wheels are arranged at a front end of the treadmill head frame.

In the above technical solution, preferably, first positioning shafts and second positioning shafts for limiting a rotation range of the treadmill head frame are fixed at the front end of the treadmill main body frame.

In the above technical solution, preferably, a first unit capable of rotating relative to the treadmill head frame is arranged on the treadmill head frame, and a second unit cooperating with the first unit is rotatably connected to the treadmill main body frame, when the treadmill head frame is turned to lift the treadmill main body frame, the first unit and the second unit being relatively contracted; and when the treadmill head frame is turned to lower the treadmill main body frame, the first unit and the second unit being relatively stretched.

In the above technical solution, preferably, a second driving unit is rotatably connected to the treadmill head frame, and the first unit is connected to the second driving unit in a transmission manner and may rotate synchronously with the second driving unit, the second driving unit being used for controlling the stretching and contraction movement of the first unit and the second unit.

In the above technical solution, preferably, the first unit is a screw and the second unit is a threaded sleeve threadedly engaged with the first unit.

In the above technical solution, preferably, the second driving unit includes an outer housing body, an electric motor and a transmission gear arranged in the outer housing body, the outer housing body being rotatably arranged at an outer end of the treadmill head frame, the transmission gear being meshed with a gear on an output shaft of the electric motor to connect the two in a transmission manner, and the screw being fixedly connected to the transmission gear.

In the above technical solution, preferably, the front end of the treadmill main body frame includes an inner-end cross rod, and the second unit is rotatably connected to the inner-end cross rod.

In the above technical solution, preferably, a first connecting member is fixedly arranged at the outer end of the treadmill head frame, the first connecting member including a first built-in cavity, and at least part of the second driving unit is arranged in the first built-in cavity and is rotatably connected to a pin shaft or bolt passing through the first connecting member; and a second connecting member is fixedly arranged at the front end of the treadmill main body frame, the second connecting member including a second built-in cavity, and an inner end of the second unit is arranged in the second built-in cavity and is rotatably connected to a pin shaft or bolt passing through the second connecting member.

In the above technical solution, preferably, the first unit includes a plurality of first positioning holes, and the second unit includes a second positioning hole; and the first unit and the second unit are relatively positioned through a second positioning pin passing through the second positioning hole and the corresponding first positioning hole.

In the above technical solution, preferably, a first connecting member is fixedly arranged at the outer end of the treadmill head frame, the first connecting member including a first built-in cavity, and one end of the first unit is arranged in the first built-in cavity and is rotatably connected to a pin shaft or bolt passing through the first connecting member; and a second connecting member is fixedly arranged at the front end of the treadmill main body frame, the second connecting member including a second built-in cavity, and an inner end of the second unit is arranged in the second built-in cavity and is rotatably connected to a pin shaft or bolt passing through the second connecting member.

In the above technical solution, preferably, the treadmill head frame includes a front rod and two support rods arranged at two ends of the front rod, the two support rods being rotatably connected to two sides of the front end of the treadmill main body frame.

In the above technical solution, preferably, end portions of the support rods facing the treadmill main body frame are in a circular arc shape; and when the treadmill is in a horizontal state, the first positioning shafts are located above the support rods, and the second positioning shafts are abutted against circular arc-shaped end portions of the support rods or are located on sides of the circular arc-shaped end portions of the support rods.

The present disclosure has the following beneficial effects.

A front part of the treadmill of the present disclosure can be turned integrally, and a front housing of the treadmill can be driven to be turned synchronously during the turning of the front part to cause the front housing of the treadmill to avoid the front and rear movement range of feet of a user during running, and prevent the user from kicking the front housing of the treadmill when running, increasing a movable range of the user on the treadmill platform since the front housing of the treadmill is avoided to be kicked.

A turnable length of the present application is longer than that of turnable support legs, so that a front end of the treadmill can be lifted higher and an adjustable slope range of the treadmill is wider.

After the front part of the treadmill is downturned integrally, a "panoramic treadmill platform" effect is formed visually, making the integral structure more beautiful.

DETAILED DESCRIPTION

Figure 1:
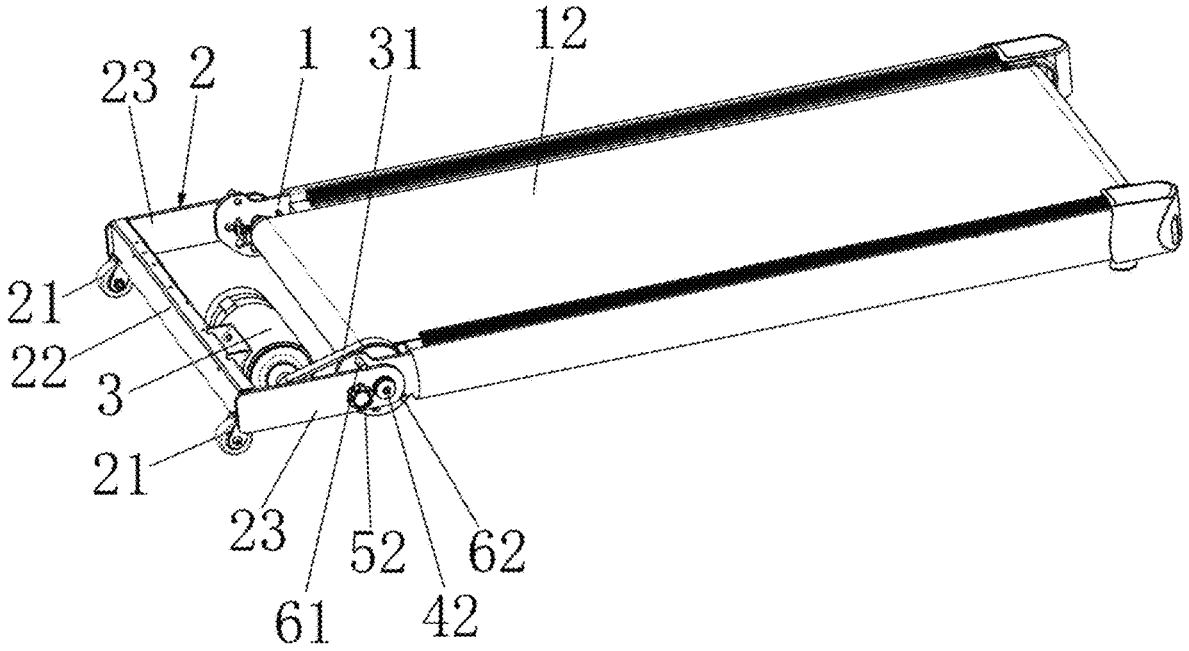
FIG. 1 is a schematic diagram of Example 1 of the present disclosure.
Figure 2:
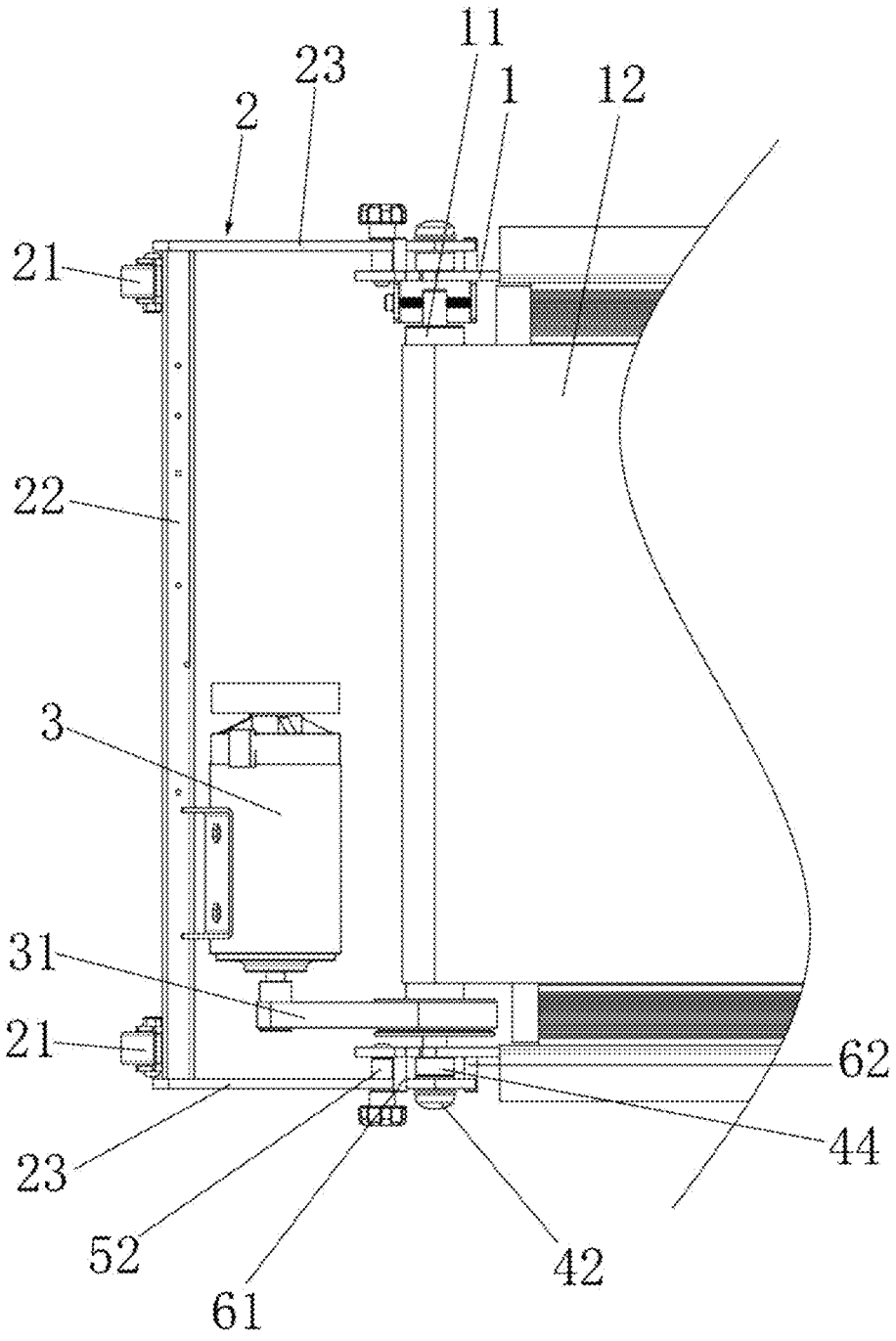
FIG. 2 is a schematic top view of Example 1 of the present disclosure.

The present disclosure is further described in detail with the attached drawings and specific implementations.

Example 1

Referring to FIGS. 1-13, a treadmill with a lifting structure includes a treadmill main body frame 1 and a treadmill head frame 2 rotatably connected to the treadmill main body frame 1, that is, an existing common treadmill frame is divided into two parts in the present application: the treadmill main body frame 1 and the treadmill head frame 2. The treadmill head frame 2 is used as a lifting structure, and a front end of the treadmill is lifted by turning the treadmill head frame 2, so that a treadmill platform is inclined for climbing exercise.

In the example, a driving roller 11 is rotatably arranged at a front end of the treadmill main body frame 1, a driven roller is rotatably arranged at a rear end, and a running belt 12 is sleeved on the driving roller 11 and the driven roller. This design is the same as the existing design. In fact, arrangement positions of the driving roller, the driven roller and the running belt in the existing treadmill are the same as or similar to those in the present application. After the design in the present application is improved, there is no reduction in running-related effects for users.

The power of the driving roller 11 is provided by a first driving unit 3 fixed on the treadmill head frame 2 or the treadmill main body frame 1. When the first driving unit 3 is fixed on the treadmill head frame 2, the first driving unit 3 moves synchronously as the treadmill head frame 2 is turned; and when the first driving unit 3 is fixed on the treadmill main body frame 1, the first driving unit 3 can be specifically arranged at a bottom of the treadmill without interfering with the running belt of the treadmill, and is located below the running belt of the treadmill and fixed on a support rod of the treadmill main body frame 1.

The transmission between the first driving unit 3 and the driving roller 11 can be realized by means of a belt 31 or chain. As an alternative, the first driving unit 3 can be an electric motor.

When the first driving unit 3 is fixed on the treadmill head frame 2, since the first driving unit 3 is turned along with the turning of the treadmill head frame 2, and the driving roller 11 is required to be rotated continuously to provide the power required for the running belt. As a preference, a rotational connection point of the driving roller 11 is concentric with that of the treadmill head frame 2, so that the power required for the driving roller 11 can be provided stably no matter how the first driving unit 3 is turned.

Since the belt or chain has a certain tension and a certain controllable elongation range, especially the belt, as an alternative, a rotational connection point of the driving roller 11 may be eccentric with that of the treadmill head frame 2, but the deviation is not to be too large. In the example, the spacing between the rotational connection point of the driving roller 11 and that of the treadmill head frame 2 ranges from 0 mm to 25 mm.

A front part of the treadmill is used for mounting the first driving unit 3, and can also be used for mounting other elements, such as a display screen, a loudspeaker, a controller, and various lines. Mounting positions and mounting modes of various elements are not considered in the present application, and the existing design can be referenced. In addition, the same as the existing design, a treadmill head housing 7 is likewise mounted on the treadmill head frame 2, and the treadmill head housing 7 is also turned along with the turning of the treadmill head frame 2. In a climbing mode, after the treadmill head housing 7 is turned, more sufficient movable space is provided for a user. The user is not affected by the treadmill head housing when running to a front end of the running belt 12, which is not possible with existing treadmills.

The treadmill head housing 7 includes an upper housing body 71 and a lower housing body 72 assembled and cooperated with each other, and components such as the treadmill head frame 2 and the first driving unit 3 (when the first driving unit is arranged on the treadmill head) are contained in the treadmill head housing 7.

Figure 5:
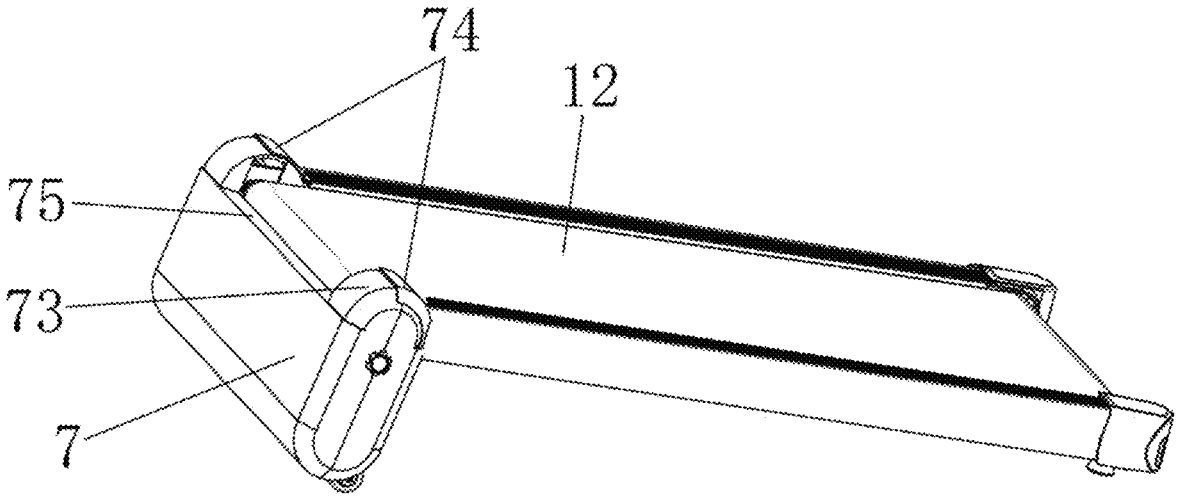
FIG. 5 is a schematic diagram of a treadmill of the present disclosure in an inclined state.
Figure 6:
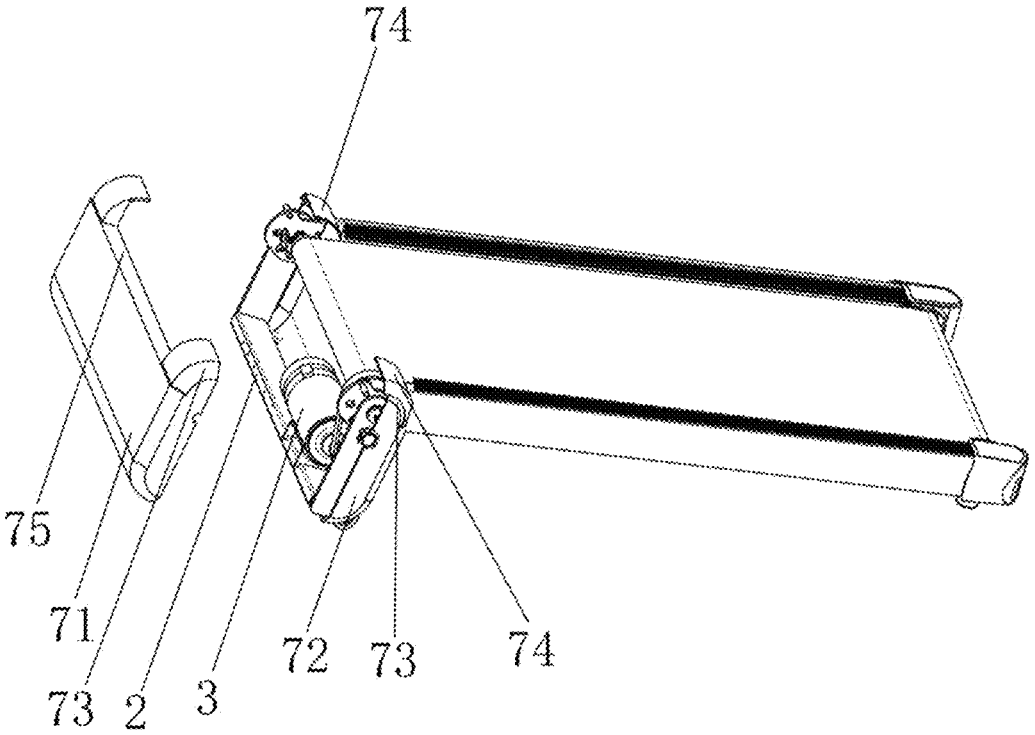
FIG. 6 is a schematic diagram of a head housing of a treadmill of Example 1 of the present disclosure in an exploded state.

A state of the treadmill head frame 2 after being turned is as shown in FIG. 5. It is ensured that the treadmill head housing 7 is not interfered by other parts of the treadmill when it is turned along with the treadmill head frame 2. As an alternative, one end of the treadmill head housing 7 close to the treadmill main body frame 1 is in a circular arc shape, which is named as arc-shaped end 73 for the convenience of understanding. It is ensured that the arc-shaped end 73 is not interfered by other parts of the treadmill when it is turned along with the treadmill head frame 2.

As an alternative, arc-shaped baffles 74 cooperating with the arc-shaped ends 73 of the treadmill head housing 7 are fixed on the treadmill main body frame 1, so that the integrity and coordination of the treadmill are better when the treadmill is in a horizontal state.

Figure 7:
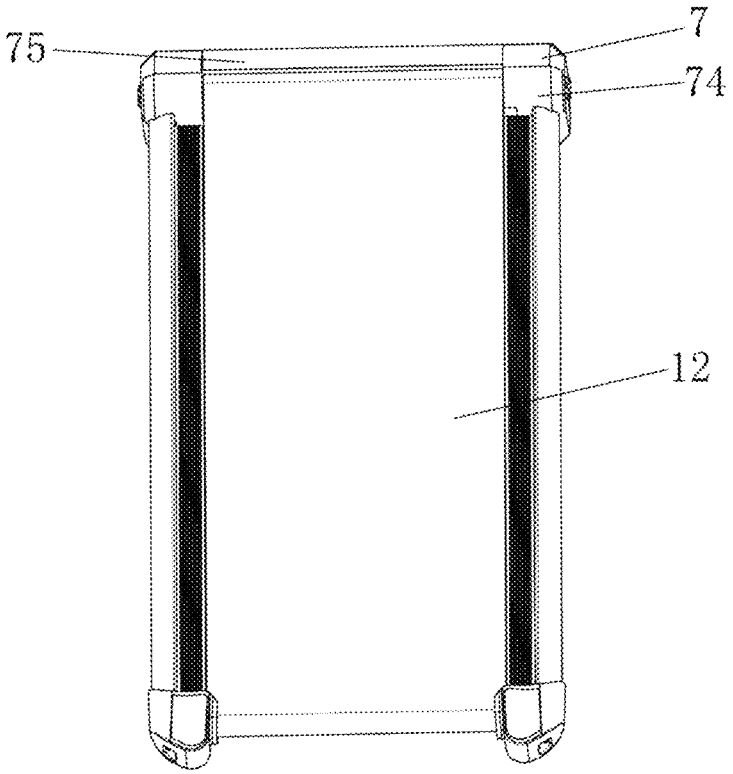
FIG. 7 is a schematic diagram of a treadmill head frame of the present disclosure after being turned from the perspective of a user.
Figure 8:
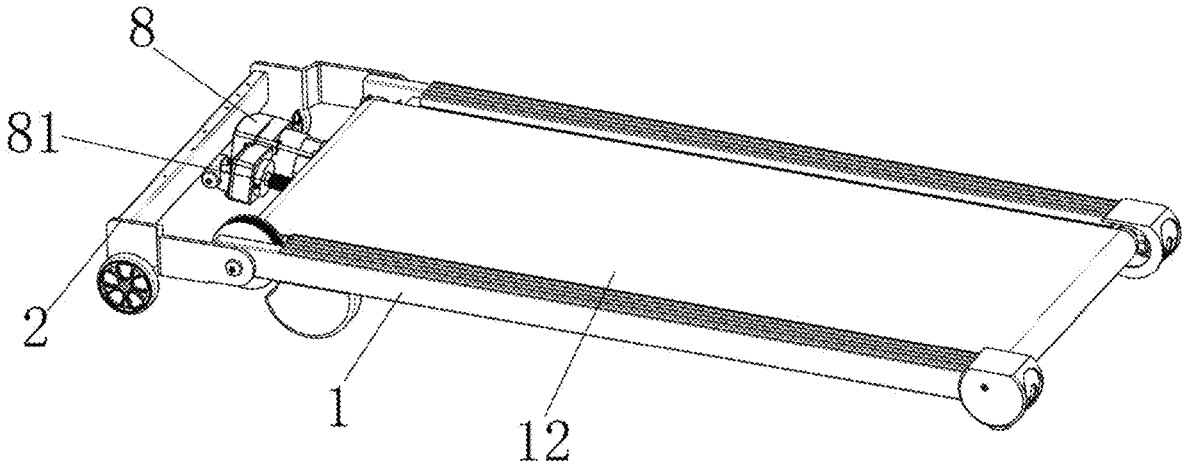
FIG. 8 is a schematic diagram of Example 2 of the present disclosure.
Figure 9:
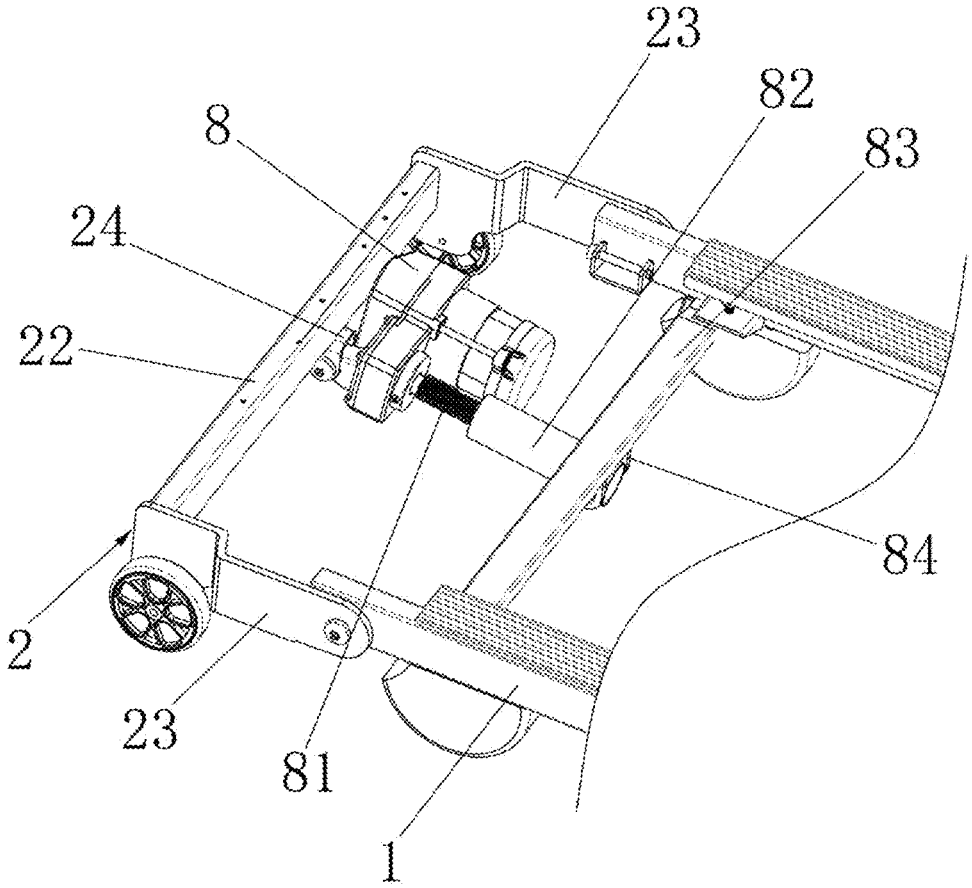
FIG. 9 is a schematic diagram of a partial front part of Example 2 of the present disclosure.
Figure 10:
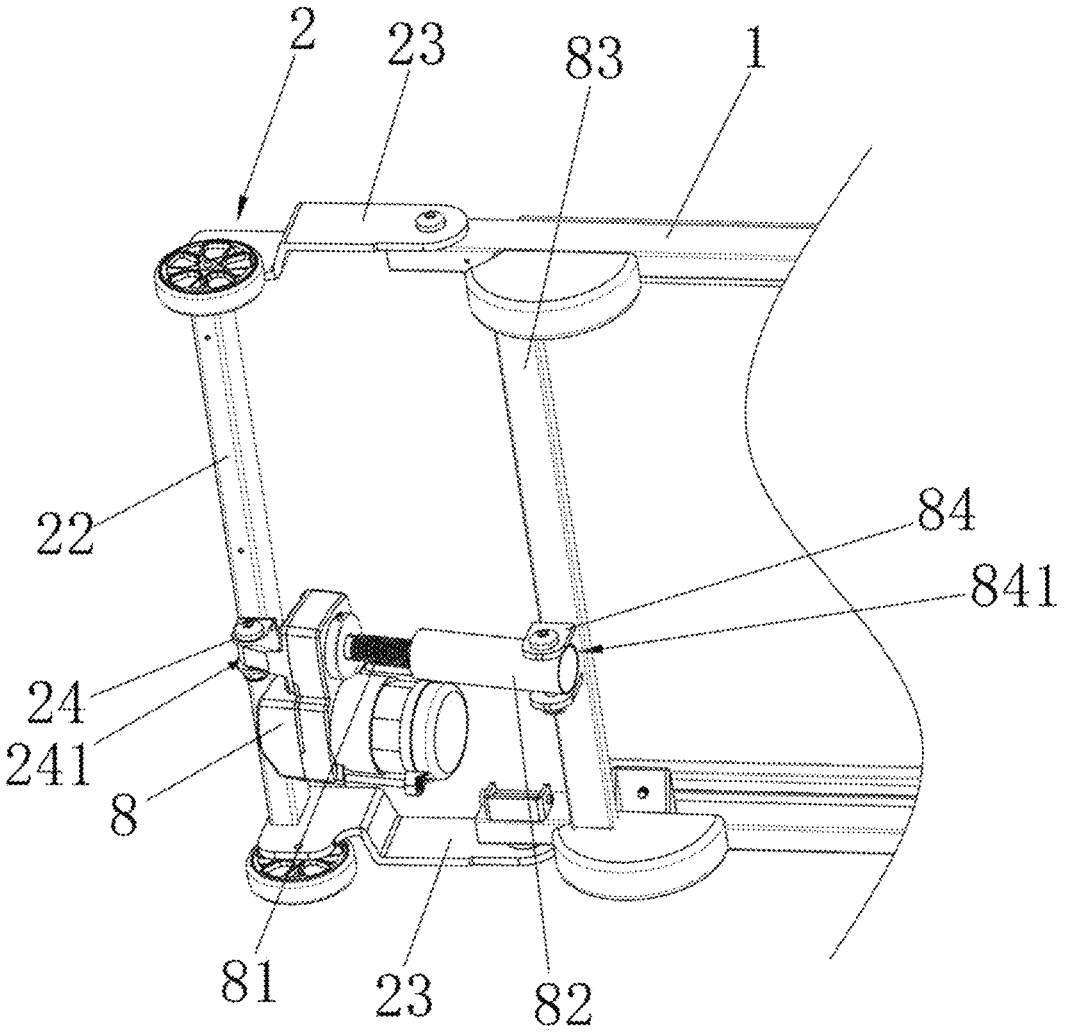
FIG. 10 is a schematic diagram of a partial front structure of Example 2 of the present disclosure from another perspective.

As an alternative, one end of the upper housing body 71 close to the treadmill main body frame 1 has a baffle strip 75, which is vertical or tends to be vertical relative to a top surface wall of the treadmill head housing 7, and is used for shielding components in the treadmill head housing 7 after the treadmill head frame 2 is turned, as shown in FIG. 7. After the baffle strip 75 is arranged, the components in the treadmill head housing cannot be seen from the perspective of the user during running.

It is well known that when the user runs, any blocking components cannot be in the front and rear movement range of feet of the user. The existing front end housing of the treadmill limits that the user can only move within a certain range of the running belt, and under the running belt of the same size, the design improvement of the present application can provide the user with a more sufficient movable range, which is equivalent to lengthening the length of the running belt. This is an added effect at the same cost. In the present application, in the process that the treadmill head frame is turned to lift the treadmill main body frame, the treadmill head frame has at least one position to cause a side of the treadmill head housing opposite to the running belt to be lower than an end of the running belt close to the treadmill head housing. The side of the treadmill head housing opposite to the running belt specifically refers to a part of the treadmill head housing to which the user would kick when running at the front end of the running belt, such as the baffle strip 75, and a panel on which an upper surface of the treadmill head housing is located.

Compared with turnable support legs, the treadmill head frame greatly increases the length of a "rotating arm". The longer the length of the "rotating arm", the higher the height that the treadmill main body frame can be lifted, and more slope modes can be selected by users, and the support effect remains after lifting.

It can be seen from the attached drawings of the specification of the present application that after the front part of the treadmill is downturned integrally, from the perspective of the user standing on the treadmill, the front part of the treadmill is hidden below the treadmill platform, and a "panoramic treadmill" effect visually is formed, bringing a visual effect such as a full-screen mobile phone and a panoramic skylight, and making the integral structure more beautiful, as shown in FIG. 7.

In order to facilitate the support of the treadmill head frame 2, in the example, a plurality of support wheels 21 are arranged at the front end of the treadmill head frame 2, and the support wheels 21 can serve as a ground-contacting part when the treadmill head frame 2 is turned to facilitate the turning of the treadmill head frame 2. As an alternative, two support wheels 21 may be mounted on two sides of the front end of the treadmill head frame 2.

In the example, the treadmill head frame 2 includes a front rod 22 and two support rods 23 arranged at two ends of the front rod 22. The two support rods 23 are rotatably connected to two sides of the front end of the treadmill main body frame 1. The front rod 22 and the two support rods 23 can be integrally formed, welded or fixedly connected by a fastener to be integral. The support wheels 21 and the first driving unit 3 (when the first driving unit 3 is fixed on the treadmill head frame) can be fixedly mounted on the front rod 22. The support wheels 21 are mounted at a bottom of the front rod 22, and the first driving unit 3 is mounted on an inner side wall of the front rod 22; and the space between the inner side wall of the front rod 22 and the running belt 12 may be used to accommodate other elements.

Figure 3:
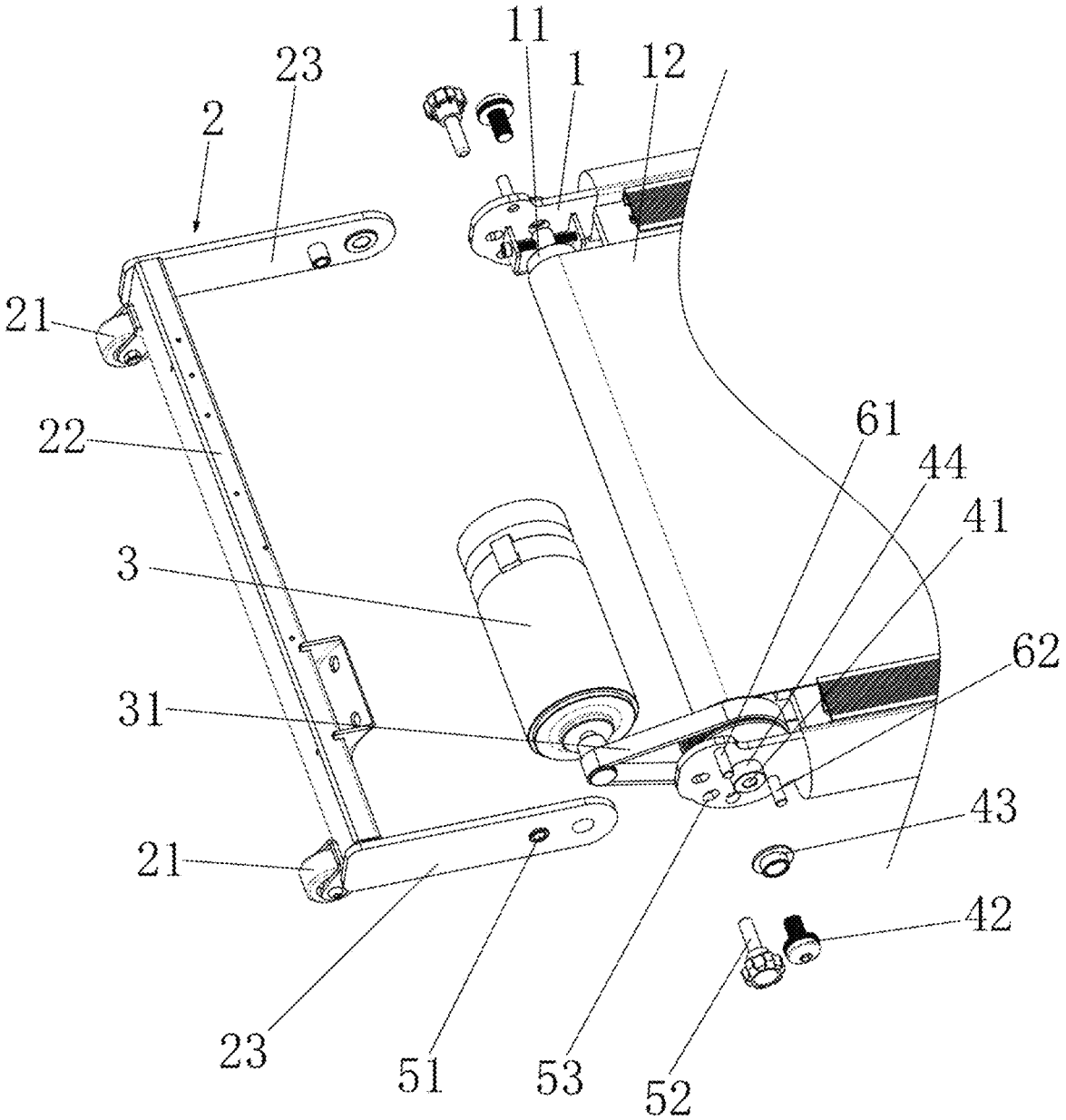
FIG. 3 is a schematic diagram of Example 1 of the present disclosure in an exploded state.
Figure 4:
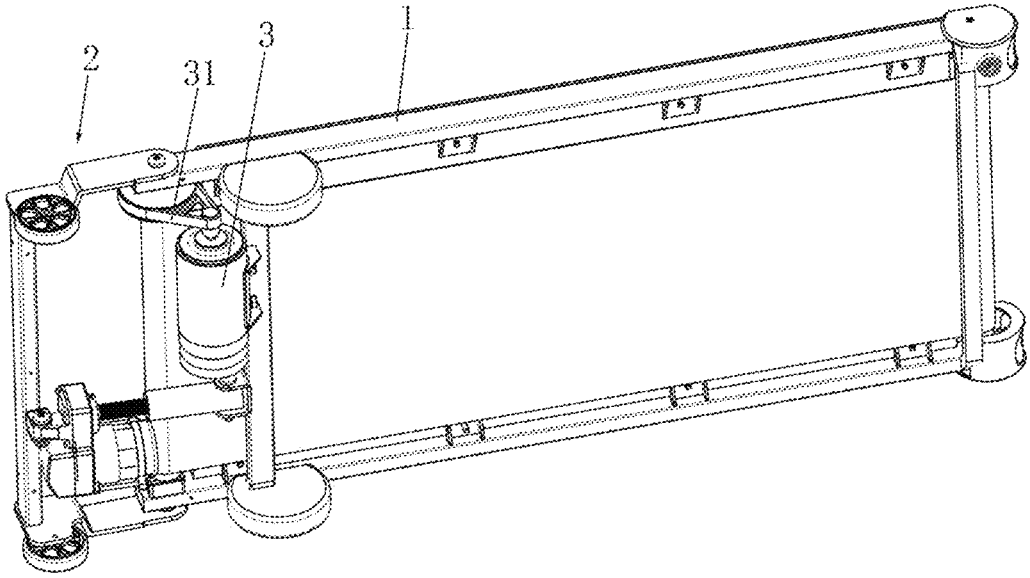
FIG. 4 is a schematic diagram showing that a first driving unit of the present disclosure is fixed on a treadmill main body frame.

As shown in FIG. 3, the front end of the treadmill main body frame 1 includes threaded holes 41, bolts 42 are threadedly connected to the threaded holes 41, and shaft sleeves 43 are sleeved on the bolts 42; and the support rods 23 are rotatably connected to the shaft sleeves 43 to form the rotational fit between the treadmill head frame 2 and the treadmill main body frame 1.

In order to make the overall structure more compact, the front end of the treadmill main body frame 1 can be a metal plate. As an alternative, components 44 with internal threads are fixed on an outer wall of the front end of the treadmill main body frame 1, the threaded holes 41 are disposed on the components, and the bolts 42 are threadedly connected to the components 44. The design of the components satisfies the mounting requirements of the driving roller 11 and the treadmill head frame 2 when the two are designed concentrically, and at the same time, the components can serve as gaskets, so that certain gaps can be left between the support rods 23 and the treadmill main body frame 1 to avoid the friction damage of the two during turning.

After turned to an appropriate position, the treadmill head frame 2 is required to be positioned to keep the treadmill stably at a required angle. In the example, first holes 51 are disposed on the treadmill head frame 2, first positioning pins 52 are arranged on the first holes 51, and a plurality of second holes 53 cooperating with the first positioning pins 52 are disposed on the treadmill main body frame 1. When the treadmill head frame 2 is required to be turned, inner ends of the first positioning pins 52 are separated from the second holes 53; and when the treadmill head frame 2 is required to be positioned, the inner ends of the first positioning pins 52 may be inserted into the corresponding second holes 53.

The first holes 51 and the first positioning pins 52 can be movably connected or can be in a form of a threaded fit. In the form of a movable connection, the first positioning pins 52 are operated in a push-pull manner; and in the form of a threaded fit, the first positioning pins 52 are operated in a rotational manner.

A slope of the treadmill is determined by a turn angle of the treadmill head frame 2, and when the user needs to position the treadmill head frame 2 at the required angle, the corresponding second holes 53 are required for cooperating with the first positioning pins 52, therefore, the position setting of the plurality of second holes 53 has certain requirements. In the example, arrangement positions of the second holes 53 correspond to movement paths of the first holes 51, that is, the first holes 51 perform circular arc-shaped actions along with the turning of the treadmill head frame 2, taking rotational connection points of the support rods 23 as centers. The second holes 53 are disposed within forward projections of the movement paths of the first holes 51 to have the corresponding second holes 53 for the insertion of the first positioning pins when the treadmill head frame 2 is turned to the appropriate position.

The number of the second holes 53 can be set according to actual needs, and if three second holes are set, the treadmill head frame 2 can be locked at three corresponding positions to provide a mode with three different intensities.

By the cooperation of the first positioning pins 52, the first holes 51 and the second holes 53, a positioning unit required for positioning the treadmill head frame 2 is formed.

In the example, first positioning shafts 61 and second positioning shafts 62 for limiting a rotation range of the treadmill head frame 2 are fixed at the front end of the treadmill main body frame 1. The first positioning shafts 61 are used for limiting an upturn range of the treadmill head frame 2, and the second positioning shafts 62 are used for limiting a downturn range of the treadmill head frame 2, so that the user can quickly and accurately know the maximum range that the treadmill head frame can be turned.

As an alternative, end portions of the support rods 23 facing the treadmill main body frame 1 are in a circular arc shape to prevent the support rods 23, when rotating, from interfering with the second positioning shafts 62.

When the treadmill platform is in a horizontal state, the treadmill head frame 2 is in a first position, and at this time, the first positioning shafts 61 are located above the support rods 23, and the second positioning shafts 62 are abutted against circular arc-shaped end portions of the support rods 23 or are located at sides of the circular arc-shaped end portions of the support rods 23; and when the treadmill platform is in an inclined state, the treadmill head frame 2 is in a second position, that is, all inclined states of the treadmill platform are considered to be the second position of the treadmill head frame.

Example 2: compared with Example 1, the difference lies in that the example adopts an electric control treadmill head frame to turn and position, and the arrangements of a first driving unit and relevant structures are the same.

Referring to FIGS. 1-13, a treadmill with a lifting structure includes a treadmill main body frame 1 and a treadmill head frame 2 rotatably connected to the treadmill main body frame 1, that is, an existing common treadmill frame is divided into two parts in the present application: the treadmill main body frame 1 and the treadmill head frame 2. The treadmill head frame 2 is used as a lifting structure, and a front end of the treadmill is lifted by turning the treadmill head frame 2, so that a treadmill platform is inclined for climbing exercise.

In the example, a driving roller is rotatably arranged at a front end of the treadmill main body frame 1, a driven roller is rotatably arranged at a rear end, and a running belt 12 is sleeved on the driving roller and the driven roller. This design is the same as the existing design. In fact, arrangement positions of the driving roller, the driven roller and the running belt in the existing treadmill are the same as or similar to those in the present application. After the design in the present application is improved, there is no reduction in running-related effects for users.

Figure 11:
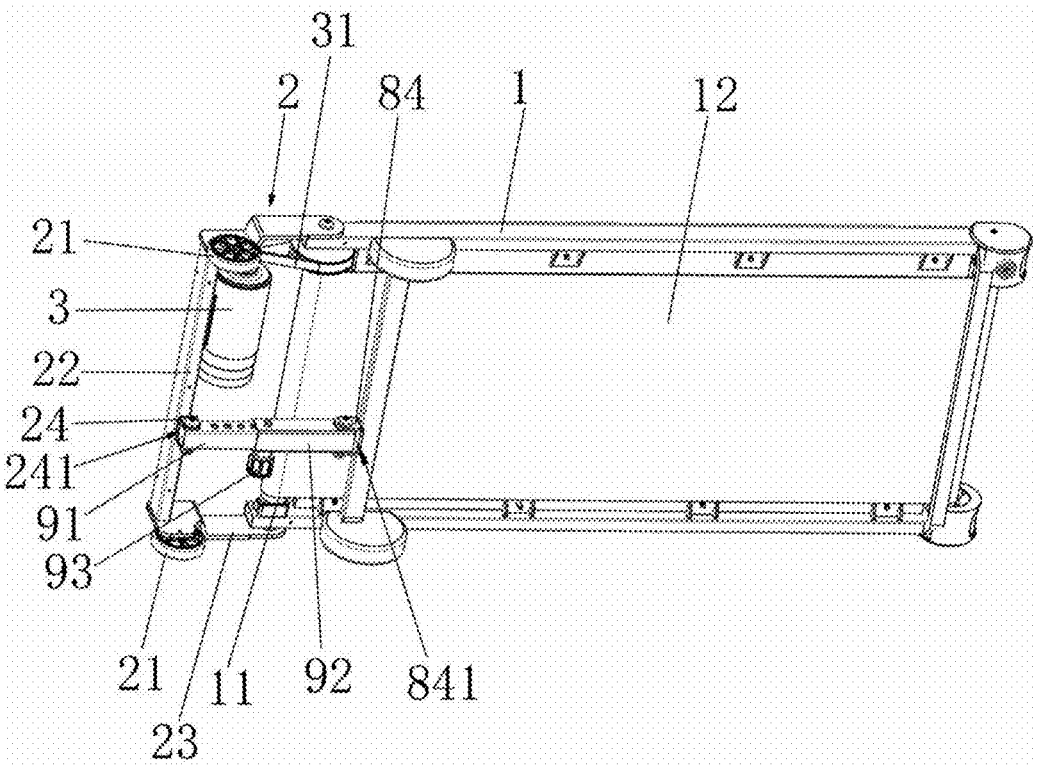
FIG. 11 is a schematic diagram of Example 3 of the present disclosure.
Figure 12:
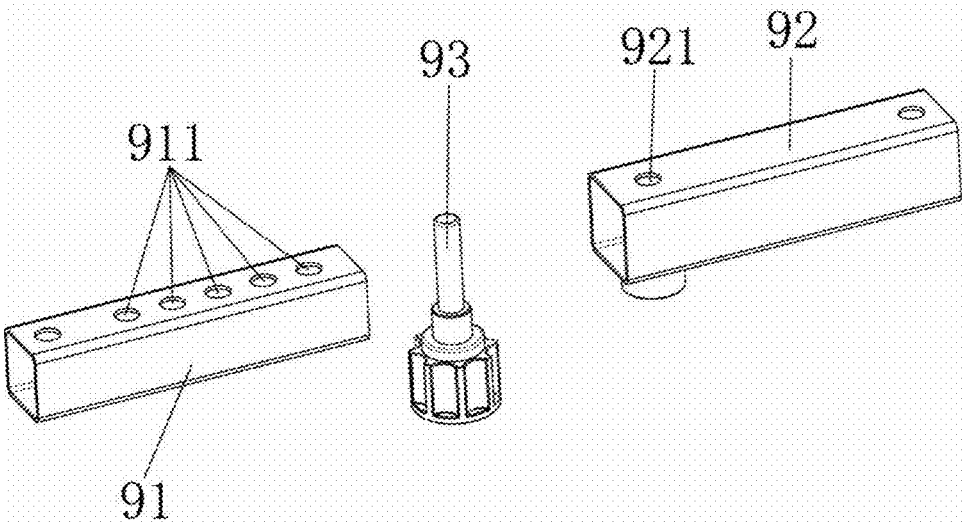
FIG. 12 is a schematic diagram of a first unit, a second positioning pin and a second unit of Example 3 of the present disclosure in an exploded state.
Figure 13:
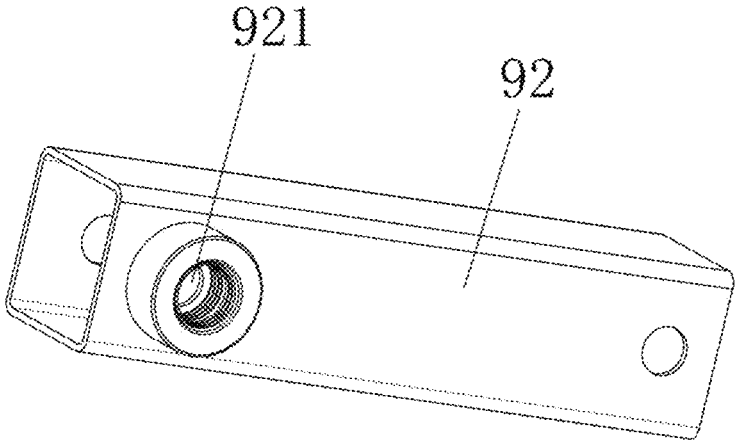
FIG. 13 is a schematic diagram of a second unit of Example 3 of the present disclosure.

In the example, the treadmill head frame 2 includes a front rod 22 and two support rods 23 fixed at two ends of the front rod 22. The two support rods 23 can be fixed at two end portions of the front rod 22 by means of welding, integral forming or bolts, and the other ends of the two support rods 23 are rotatably connected to two sides of the front end of the treadmill main body frame 1, as shown in FIG. 11.

A second driving unit 8 is used for providing a power output. As an alternative, the second driving unit 8 includes an outer housing body, an electric motor and a transmission gear mounted in the outer housing body, which is divided into a part for accommodating the electric motor and a part for accommodating the transmission gear. A front end of the part for accommodating the transmission gear is rotatably connected to the front rod.

In the example, a first connecting member 24 is fixed at a bottom of the front rod 22. The first connecting member 24 can be a metal bending member and includes a first built-in cavity 241. A front end of the portion for accommodating the transmission gear is arranged in the first built-in cavity 241 and is rotatably connected to a pin shaft or bolt passing through the first connecting member 24.

Therefore, in the case where the electric motor is engaged with the transmission gear in a transmission manner, the second driving unit as a whole (including the outer housing body) is rotatably engaged with the front rod.

Further, a screw 81 is fixed on the transmission gear and passes through the outer housing body and extends to the outside. A threaded sleeve 82 is cooperated with the screw 81, and the threaded sleeve 82 is rotatably connected to the front end of the treadmill main body frame 1.

Specifically, the front end of the treadmill main body frame 1 includes an inner-end cross rod 83, and a second connecting member 84 is fixedly arranged at a bottom of the inner-end cross rod 83. The second connecting member 84 can be a metal bending piece and includes a second built-in cavity 841. An inner end of the threaded sleeve 82 is arranged in the second built-in cavity 841 and is rotatably connected to a pin shaft or bolt passing through the second connecting member 84, thereby forming the rotational fit between the threaded sleeve 82 and the inner-end cross rod 83.

In the example, the threaded sleeve 82 includes an inner cavity with internal threads, and one end of the screw 81 penetrates into the inner cavity and is threadedly connected to the inner cavity. When the electric motor is started, the screw 81 is driven to rotate, relying on the threaded fit between the screw 81 and the threaded sleeve 82 and a corresponding rotation fit form. When the screw 81 is rotated in one direction, the screw 81 and the threaded sleeve 82 are gradually converged; and at this time, the treadmill head frame 2 is turned around the treadmill main body frame 1, thereby lifting the front end of the treadmill platform to incline the treadmill incline. When the screw 81 is rotated in a reverse direction, the screw 81 and the threaded sleeve 82 are gradually separated, and at this time, the treadmill head frame 2 is turned around the treadmill main body frame 1, thereby lowering the front end of the treadmill platform to restore the treadmill platform to a horizontal state.

The power of the driving roller 11 is provided by a first driving unit 3 fixed on the treadmill head frame 2 or the treadmill main body frame 1. When the first driving unit 3 is fixed on the treadmill head frame 2, the first driving unit 3 moves synchronously as the treadmill head frame 2 is turned; and when the first driving unit 3 is fixed on the treadmill main body frame 1, the first driving unit 3 can be specifically arranged at a bottom of the treadmill without interfering with the running belt of the treadmill, and is located below the running belt of the treadmill and fixed on a support rod of the treadmill main body frame 1.

The transmission between the first driving unit 3 and the driving roller 11 can be realized by means of a belt 31 or chain. As an alternative, the first driving unit 3 can be an electric motor.

When the first driving unit 3 is fixed on the treadmill head frame 2, since the first driving unit 3 is turned along with the turning of the treadmill head frame 2, and the driving roller 11 is required to be rotated continuously to provide the power required for the running belt. As a preference, a rotational connection point of the driving roller 11 is concentric with that of the treadmill head frame 2, so that the power required for the driving roller 11 can be provided stably no matter how the first driving unit 3 is turned.

Since the belt or chain has a certain tension and a certain controllable elongation range, especially the belt, as an alternative, a rotational connection point of the driving roller 11 may be eccentric with that of the treadmill head frame 2, but the deviation is not to be too large. In the example, the spacing between the rotational connection point of the driving roller 11 and that of the treadmill head frame 2 ranges from 0 mm to 25 mm.

A front part of the treadmill is used for mounting the first driving unit 3, and can also be used for mounting other elements, such as a display screen, a loudspeaker, a controller, and various lines. Mounting positions and mounting modes of various elements are not considered in the present application, and the existing design can be referenced. In addition, the same as the existing design, a treadmill head housing 7 is likewise mounted on the treadmill head frame 2, and the treadmill head housing 7 is also turned along with the turning of the treadmill head frame 2. In a climbing mode, after the treadmill head housing 7 is turned, more sufficient movable space is provided for a user. The user is not affected by the treadmill head housing when running to a front end of the running belt 12, which is not possible with existing treadmills.

The treadmill head housing 7 includes an upper housing body 71 and a lower housing body 72 assembled and cooperated with each other, and components such as the treadmill head frame 2 and the first driving unit 3 (when the first driving unit is arranged on the treadmill head) are contained in the treadmill head housing 7.

A state of the treadmill head frame 2 after being turned is as shown in FIG. 5. It is ensured that the treadmill head housing 7 is not interfered by other parts of the treadmill when it is turned along with the treadmill head frame 2. As an alternative, one end of the treadmill head housing 7 close to the treadmill main body frame 1 is in a circular arc shape, which is named as arc-shaped end 73 for the convenience of understanding. It is ensured that the arc-shaped end 73 is not interfered by other parts of the treadmill when it is turned along with the treadmill head frame 2.

As an alternative, arc-shaped baffles 74 cooperating with the arc-shaped ends 73 of the treadmill head housing 7 are fixed on the treadmill main body frame 1, so that the integrity and coordination of the treadmill are better when the treadmill is in a horizontal state.

As an alternative, one end of the upper housing body 71 close to the treadmill main body frame 1 has a baffle strip 75, which is vertical or tends to be vertical relative to a top surface wall of the treadmill head housing 7, and is used for shielding components in the treadmill head housing 7 after the treadmill head frame 2 is turned, as shown in FIG. 7. After the baffle strip 75 is arranged, the components in the treadmill head housing cannot be seen from the perspective of the user during running.

It is well known that when the user runs, any blocking components cannot be in the front and rear movement range of feet of the user. The existing front end housing of the treadmill limits that the user can only move within a certain range of the running belt, and under the running belt of the same size, the design improvement of the present application can provide the user with a more sufficient movable range, which is equivalent to lengthening the length of the running belt. This is an added effect at the same cost. In the present application, in the process that the treadmill head frame is turned to lift the treadmill main body frame, the treadmill head frame has at least one position to cause a side of the treadmill head housing opposite to the running belt to be lower than an end of the running belt close to the treadmill head housing. The side of the treadmill head housing opposite to the running belt specifically refers to a part of the treadmill head housing to which the user would kick when running at the front end of the running belt, such as the baffle strip 75, and a panel on which an upper surface of the treadmill head housing is located.

Compared with turnable support legs, the treadmill head frame greatly increases the length of a "rotating arm". The longer the length of the "rotating arm", the higher the height that the treadmill main body frame can be lifted, and more slope modes can be selected by users, and the support effect remains after lifting.

After the front part of the treadmill is downturned integrally, from the perspective of the user standing on the treadmill, the front part of the treadmill is hidden below the treadmill platform, and a "panoramic treadmill" effect visually is formed, bringing a visual effect such as a full-screen mobile phone and a panoramic skylight, and making the integral structure more beautiful.

In order to facilitate the support of the treadmill head frame 2, in the example, a plurality of support wheels 21 are arranged at the front end of the treadmill head frame 2, and the support wheels 21 can serve as a ground-contacting part when the treadmill head frame 2 is turned to facilitate the turning of the treadmill head frame 2. As an alternative, two support wheels 21 may be mounted on two sides of the front end of the treadmill head frame 2.

Example 3: compared with Example 1, the difference lies in that a structure for positioning a treadmill head frame is different, and the arrangements of a first driving unit and relevant structures are the same.

Referring to FIGS. 1-13, a treadmill with a lifting structure includes a treadmill main body frame 1 and a treadmill head frame 2 rotatably connected to the treadmill main body frame 1, that is, an existing common treadmill frame is divided into two parts in the present application: the treadmill main body frame 1 and the treadmill head frame 2. The treadmill head frame 2 is used as a lifting structure, and a front end of the treadmill is lifted by turning the treadmill head frame 2, so that a treadmill platform is inclined for climbing exercise.

In the example, a driving roller 11 is rotatably arranged at a front end of the treadmill main body frame 1, a driven roller is rotatably arranged at a rear end, and a running belt 12 is sleeved on the driving roller 11 and the driven roller. This design is the same as the existing design. In fact, arrangement positions of the driving roller, the driven roller and the running belt in the existing treadmill are the same as or similar to those in the present application. After the design in the present application is improved, there is no reduction in running-related effects for users.

The power of the driving roller 11 is provided by a first driving unit 3 fixed on the treadmill head frame 2 or the treadmill main body frame 1. When the first driving unit 3 is fixed on the treadmill head frame 2, the first driving unit 3 moves synchronously as the treadmill head frame 2 is turned; and when the first driving unit 3 is fixed on the treadmill main body frame 1, the first driving unit 3 can be specifically arranged at a bottom of the treadmill without interfering with the running belt of the treadmill, and is located below the running belt of the treadmill and fixed on a support rod of the treadmill main body frame 1.

The transmission between the first driving unit 3 and the driving roller 11 can be realized by means of a belt 31 or chain. As an alternative, the first driving unit 3 can be an electric motor.

When the first driving unit 3 is fixed on the treadmill head frame 2, since the first driving unit 3 is turned along with the turning of the treadmill head frame 2, and the driving roller 11 is required to be rotated continuously to provide the power required for the running belt. As a preference, a rotational connection point of the driving roller 11 is concentric with that of the treadmill head frame 2, so that the power required for the driving roller 11 can be provided stably no matter how the first driving unit 3 is turned.

Since the belt or chain has a certain tension and a certain controllable elongation range, especially the belt, as an alternative, a rotational connection point of the driving roller 11 may be eccentric with that of the treadmill head frame 2, but the deviation is not to be too large. In the example, the spacing between the rotational connection point of the driving roller 11 and that of the treadmill head frame 2 ranges from 0 mm to 25 mm.

A front part of the treadmill is used for mounting the first driving unit 3, and can also be used for mounting other elements, such as a display screen, a loudspeaker, a controller, and various lines. Mounting positions and mounting modes of various elements are not considered in the present application, and the existing design can be referenced. In addition, the same as the existing design, a treadmill head housing 7 is likewise mounted on the treadmill head frame 2, and the treadmill head housing 7 is also turned along with the turning of the treadmill head frame 2. In a climbing mode, after the treadmill head housing 7 is turned, more sufficient movable space is provided for a user. The user is not affected by the treadmill head housing when running to a front end of the running belt 12, which is not possible with existing treadmills.

The treadmill head housing 7 includes an upper housing body 71 and a lower housing body 72 assembled and cooperated with each other, and components such as the treadmill head frame 2 and the first driving unit 3 (when the first driving unit is arranged on the treadmill head) are contained in the treadmill head housing 7.

A state of the treadmill head frame 2 after being turned is as shown in FIG. 5. It is ensured that the treadmill head housing 7 is not interfered by other parts of the treadmill when it is turned along with the treadmill head frame 2. As an alternative, one end of the treadmill head housing 7 close to the treadmill main body frame 1 is in a circular arc shape, which is named as arc-shaped end 73 for the convenience of understanding. It is ensured that the arc-shaped end 73 is not interfered by other parts of the treadmill when it is turned along with the treadmill head frame 2.

As an alternative, arc-shaped baffles 74 cooperating with the arc-shaped ends 73 of the treadmill head housing 7 are fixed on the treadmill main body frame 1, so that the integrity and coordination of the treadmill are better when the treadmill is in a horizontal state.

As an alternative, one end of the upper housing body 71 close to the treadmill main body frame 1 has a baffle strip 75, which is vertical or tends to be vertical relative to a top surface wall of the treadmill head housing 7, and is used for shielding components in the treadmill head housing 7 after the treadmill head frame 2 is turned, as shown in FIG. 7.

After the baffle strip 75 is arranged, the components in the treadmill head housing cannot be seen from the perspective of the user during running.

It is well known that when the user runs, any blocking components cannot be in the front and rear movement range of feet of the user. The existing front end housing of the treadmill limits that the user can only move within a certain range of the running belt, and under the running belt of the same size, the design improvement of the present application can provide the user with a more sufficient movable range, which is equivalent to lengthening the length of the running belt. This is an added effect at the same cost. In the present application, in the process that the treadmill head frame is turned to lift the treadmill main body frame, the treadmill head frame has at least one position to cause a side of the treadmill head housing opposite to the running belt to be lower than an end of the running belt close to the treadmill head housing. The side of the treadmill head housing opposite to the running belt specifically refers to a part of the treadmill head housing to which the user would kick when running at the front end of the running belt, such as the baffle strip 75, and a panel on which an upper surface of the treadmill head housing is located.

Compared with turnable support legs, the treadmill head frame greatly increases the length of a "rotating arm". The longer the length of the "rotating arm", the higher the height that the treadmill main body frame can be lifted, and more slope modes can be selected by users, and the support effect remains after lifting.

It can be seen from the attached drawings of the specification of the present application that after the front part of the treadmill is downturned integrally, from the perspective of the user standing on the treadmill, the front part of the treadmill is hidden below the treadmill platform, and a "panoramic treadmill" effect visually is formed, bringing a visual effect such as a full-screen mobile phone and a panoramic skylight, and making the integral structure more beautiful, as shown in FIG. 7.

In order to facilitate the support of the treadmill head frame 2, in the example, a plurality of support wheels 21 are arranged at the front end of the treadmill head frame 2, and the support wheels 21 can serve as a ground-contacting part when the treadmill head frame 2 is turned to facilitate the turning of the treadmill head frame 2. As an alternative, two support wheels 21 may be mounted on two sides of the front end of the treadmill head frame 2.

In the example, the treadmill head frame 2 includes a front rod 22 and two support rods 23 arranged at two ends of the front rod 22. The two support rods 23 are rotatably connected to two sides of the front end of the treadmill main body frame 1. The front rod 22 and the two support rods 23 can be integrally formed, welded or fixedly connected by a fastener to be integral. The support wheels 21 and the first driving unit 3 (when the first driving unit 3 is fixed on the treadmill head frame) can be fixedly mounted on the front rod 22. The support wheels 21 are mounted at a bottom of the front rod 22, and the first driving unit 3 is mounted on an inner side wall of the front rod 22; and the space between the inner side wall of the front rod 22 and the running belt 12 may be used to accommodate other elements.

As shown in FIG. 11, a first connecting member 24 is fixed at a bottom of the front rod 22. The first connecting member 24 can be a metal bending piece and includes a first built-in cavity 241. An outer end of a first unit 91 is arranged in the first built-in cavity 241 and is rotatably connected to a pin shaft or bolt passing through the first connecting member 24. Therefore, the first unit 91 is rotatably engaged with the front rod 22.

In the example, the first unit 91 includes a plurality of first positioning holes 911, and the first positioning holes 911 can be distributed on the first unit 91 in a linear manner at equal intervals.

A second connecting member 84 is fixedly arranged at the front end of the treadmill main body frame 1, the second connecting member 84 including a second built-in cavity 841. An inner end of a second unit 92 is arranged in the second built-in cavity 841 and is rotatably connected to a pin shaft or bolt passing through the second connecting member 84, thereby forming the rotational fit between the second unit 92 and the treadmill main body frame 1.

In the example, the first unit 91 is sleeved on the second unit 92 or the second unit 92 is sleeved on the first unit 91, for example, an interior of the second unit 92 has a cavity adapted to a shape of the first unit 91, the first unit 91 is loaded into the cavity, and an outer wall of the first unit 91 is adapted to an inner wall of the cavity, so that the first unit 91 and the second unit 92 form the sleeved fit and have a guiding function; or an interior of the first unit 91 has a cavity adapted to a shape of the second unit 92, the second unit 92 is loaded into the cavity, and an outer wall of the second unit 92 is adapted to an inner wall of the cavity, so that the first unit 91 and the second unit 92 form the sleeved fit and have a guiding function.

Meanwhile, corresponding to the first positioning hole 911, a second positioning hole 921 is included on the second unit 92. A second positioning pin 93 passes through the second positioning hole 921, and the second positioning pin 93 can be threadedly fitted with the second positioning hole 921. After further passing through, the second positioning pin 93 can pass through the corresponding first positioning hole 911, thereby positioning the first unit 91 and the second unit 92 through the second positioning pin 93, so that the two cannot continue the stretching and contraction actions; and at this time, the treadmill head frame 2 is positioned, while which first positioning hole 911 the second positioning pin 93 is specifically inserted into depends on which turning angle the treadmill head frame 2 is required by the user, and it can also be understood how much angle the treadmill main body frame 1 is required to be inclined.

The above examples are only used to illustrate the technical solutions of the present disclosure, but not to limit this. Although the present disclosure has been described in detail with reference to the foregoing examples, the technical solutions described in the foregoing examples can still be modified, or some technical features can be replaced by equivalents; while these modifications or substitutions do not make the essence of the corresponding technical solutions deviate from the spirit and scope of the technical solutions of various examples of the present disclosure.

The invention claimed is:

1. A treadmill, comprising:

a treadmill main body frame, a driving roller being rotatably arranged at a front end of the treadmill main body frame, a driven roller being rotatably arranged at a rear end, and a running belt being sleeved on the driving roller and the driven roller; and a treadmill head frame, the treadmill head frame being rotatably connected to the front end of the treadmill main body frame to lift or lower the treadmill main body frame, the treadmill head frame being equipped with a treadmill head housing, and the treadmill head frame having at least one position to cause a side of the treadmill head housing opposite to the running belt to be lower than an end of the running belt close to the treadmill head housing;

wherein a first unit capable of rotating relative to the treadmill head frame is arranged on the treadmill head frame, and a second unit cooperating with the first unit is rotatably connected to the treadmill main body frame, when the treadmill head frame is turned to lift the treadmill main body frame, the first unit and the second unit being relatively contracted, and when the treadmill head frame is turned to lower the treadmill main body frame, the first unit and the second unit being relatively stretched;

wherein a second driving unit is rotatably connected to the treadmill head frame, and the first unit is connected to the second driving unit in a transmission manner and may rotate synchronously with the second driving unit, the second driving unit being used for controlling the stretching and contraction movement of the first unit and the second unit;

wherein a first connecting member is fixedly arranged at an outer end of the treadmill head frame, the first connecting member comprising a first built-in cavity, and at least part of the second driving unit is arranged in the first built-in cavity and is rotatably connected to a pin shaft or bolt passing through the first connecting member; and a second connecting member is fixedly arranged at the front end of the treadmill main body frame, the second connecting member comprising a second built-in cavity, and an inner end of the second unit is arranged in the second built-in cavity and is rotatably connected to a pin shaft or bolt passing through the second connecting member.

2. The treadmill according to claim 1, wherein a first driving unit in transmission connection to the driving roller is fixedly mounted on the treadmill head frame.

3. The treadmill according to claim 2, wherein a rotational connection point of the driving roller is concentric with that of the treadmill head frame.

4. The treadmill according to claim 2, wherein the spacing between a rotational centerline of the driving roller and that of the treadmill head frame ranges from 0 mm to 25 mm.

5. The treadmill according to claim 2, wherein the first driving unit is an electric motor, and the first driving unit is connected to the driving roller via a belt or chain in a transmission manner.

6. The treadmill according to claim 1, wherein a first driving unit in transmission connection to the driving roller is fixedly mounted on the treadmill main body frame, the first driving unit being an electric motor, and the first driving unit being connected to the driving roller via a belt or chain in a transmission manner.

7. The treadmill according to claim 1, wherein a plurality of support wheels are arranged at a front end of the treadmill head frame.

8. The treadmill according to claim 1, wherein the first unit is a screw, and the second unit is a threaded sleeve threadedly engaged with the first unit.

9. The treadmill according to claim 8, wherein the second driving unit comprises an outer housing body, an electric motor and a transmission gear arranged in the outer housing body, the outer housing body being rotatably arranged at the outer end of the treadmill head frame, the transmission gear being meshed with a gear on an output shaft of the electric motor to connect the two in a transmission manner, and the screw being fixedly connected to the transmission gear.

10. The treadmill according to claim 1, wherein the front end of the treadmill main body frame comprises an inner-end cross rod, and the second unit is rotatably connected to the inner-end cross rod.

* * * * *